United States Patent [19]

Gartland, Jr. et al.

[11] Patent Number: 4,931,024

[45] Date of Patent: Jun. 5, 1990

[54] CONTACT CLIP FOR WIRING DEVICES

[75] Inventors: Albert J. Gartland, Jr., Trumbull; Michael J. Lawlor, Manchester, both of Conn.

[73] Assignee: Hubbell Incorporated, Orange, Conn.

[21] Appl. No.: 406,538

[22] Filed: Sep. 13, 1989

[51] Int. Cl.[5] ..... H01R 11/00

[52] U.S. Cl. ..... 439/856

[58] Field of Search ..... 439/856, 857, 858, 861, 439/862

[56] References Cited

U.S. PATENT DOCUMENTS

| | | | |
|---|---|---|---|
| 1,551,568 | 9/1925 | Johnson | 200/282 |
| 1,925,856 | 9/1933 | Vaughan | 200/282 |
| 2,110,197 | 3/1938 | Brownstein | 439/857 |
| 2,325,698 | 8/1943 | Millermaster | 200/282 |
| 2,771,551 | 11/1956 | Streuer | 200/282 |
| 2,920,304 | 1/1960 | Webster | 439/856 |
| 3,027,440 | 3/1962 | Daly | 200/282 |
| 3,605,059 | 9/1971 | Lipinski | 339/14 L |
| 4,241,969 | 12/1980 | D'Amato et al. | 339/88 R |

*Primary Examiner*—Joseph H. McGlynn

*Attorney, Agent, or Firm*—Jerry M. Presson; Mark S. Bicks; Alfred N. Goodman

[57] ABSTRACT

An electrical contact clip for a wiring device includes an inside and outside contact members. Each of the contact members includes a terminal portion adapted to be electrically coupled to wiring, a resilient contact portion for electrically engaging a mating contact element, and an intermediate portion extending between the terminal portion and the contact portion. The coupling members are interlocked adjacent the intermediate portions. The contact portions are preformed such that, when the contact members are interlocked, the contact portions engage and press against each other and bend about an axis transvese to the longitudinal axes of the contact members.

16 Claims, 4 Drawing Sheets

CONTACT CLIP FOR WIRING DEVICES

FIELD OF THE INVENTION

The present invention relates to an electrical contact clip for wiring devices. More particularly, the present invention relates a contact clip having a pair of contact members held together at their intermediate portions such that the preformed resilient contact portions are pressed against each other and bend about an axis transverse to the longitudinal axes of the contact members.

BACKGROUND OF THE INVENTION

Performance and reliability are two typical factors in manufacturing a double wipe female contact clip. Performance in the contact clip is measured by the amount of temperature change occurring over the terminal portion of the contact clip from a no load condition to a rated load condition when wired with the proper size conductor. The smaller the temperature change the better the performance of the contact clip. Reliability is determined by the dependability with which the contact clips can be repeatedly manufactured consistently to a set standard in high volume mass production.

Numerous conventional double wipe contact clips have their contact members interconnected by various means such as riveting, staking and welding. Examples of these conventional devices are disclosed in U.S. Pat. Nos. 1,551,568 to Johnson; 1,925,856 to Vaughan; 2,325,698 to Millermaster et al; 2,771,531 to Streuer; 3,027,440 to Daly; and 3,605,059 to Lipinski et al.

These conventional contact clips suffer from many disadvantages. For example, the quality of the electrical connection of these contact clips depends on secondary operations such as riveting, staking and welding. These secondary operations require proper set up, constant maintenance and monitoring to produce a reliable contact clip from run to run. Even with constant maintenance and monitoring of these secondary operations, many contact clips are produced with faulty connections between the contact members.

When riveting or welding is used to fasten the contact members together, the rivet or weld tends to deform or creep over a long period of time, and thus, results in subsequent failure of the contact members to maintain adequate contact pressure therebetween. When a single rivet or screw is employed to fasten the contact members together, some additional fastener must be provided to prevent rotation of one contact member relative to the other contact member. Also, upon insertion of the male blade between the contact members, the conventional devices do not provide adequate means to prevent separation between the contact members.

SUMMARY OF THE INVENTION

Accordingly, an object of the present invention is to provide an electrical contact clip having high performance and reliability.

Another object of the present invention is to provide an electrical contact clip having a pair of contact members extending the full length of each other to provide better thermal distribution and electrical connection between the contact members.

A further object of the present invention is to provide an electrical contact clip which does not require any secondary operations such as riveting, welding or stacking for connecting the contact members together.

Yet another object of the present invention is to provide an electrical contact clip in which the quality of the electrical connection between the contact members is solely a function of the preformed configuration of the two contact members.

A still further object of the present invention is to provide an electrical contact clip that is relatively inexpensive and easy to manufacture and install.

The foregoing objects are basically obtained by an electrical contact clip for a wiring device having a first contact member, a second contact member and first and second interlocking means on the first and second contact members for connecting the first and second contact members together. The first contact member has a first terminal portion, a resilient first contact portion, and a first intermediate portion. The first terminal portion is adapted to be electrically coupled to wiring. The first contact portion is adapted to electrically engage a mating contact element with the first contact portion. The first intermediate portion extends between the first terminal portion and the first contact portion. The second contact member has a second terminal portion, a resilient second contact portion, and a second intermediate portion. The second terminal portion is adapted to be electrically coupled to wiring. The second contact portion is adapted to electrically engage a mating contact element with the first contact portion. The second intermediate portion extends between the second terminal portion and the second contact portion. The interlocking means couple the contact members adjacent the intermediate portions such that the contact portions engage and press against each other and bend about an axis transverse to the longitudinal axes of the contact members.

The foregoing objects are further obtained by an electrical contact clip for a wiring device comprising a first contact member and a second contact member. The first contact member is formed of a single continuous sheet of metal and includes a first terminal portion, a resilient first contact portion and a first intermediate portion. The first terminal portion is adapted to be electrically coupled to wiring. The first contact portion is adapted to electrically engage a mating contact element. The first intermediate portion extends between the first terminal portion and the first contact portion, and has a pair of tangs extending laterally therefrom. The second contact member is formed of a single continuous sheet of metal and includes a second terminal portion, a resilient second contact portion and a second intermediate portion. The second terminal portion is adapted to be electrically coupled to wiring and has an inner surface. The second contact portion is adapted to electrically engage a mating contact element. The second intermediate portion extends between the second terminal portion and the second contact portion. The second intermediate portion has a pair of coupling flanges extending generally parallel to the second terminal portion. Each of the coupling flanges has a surface facing and spaced form the inner surface of the second terminal portion. The tangs are received between the coupling flanges and the inner surface of the second terminal portion such that the tangs are retained therebetween interlocking the first and second contact members together such that the contact portions engage and press against each other and bend about an axis transverse to the longitudinal axes of the contact members.

Other objects, advantages and salient features of the invention will become apparent from the following detailed description, which, taken in conjunction with the annexed drawings, discloses several embodiments of the invention.

BRIEF DESCRIPTION OF THE DRAWINGS

Referring to the drawings which form a part of this disclosure.

DETAILED DESCRIPTION OF THE INVENTION

Figure 1:
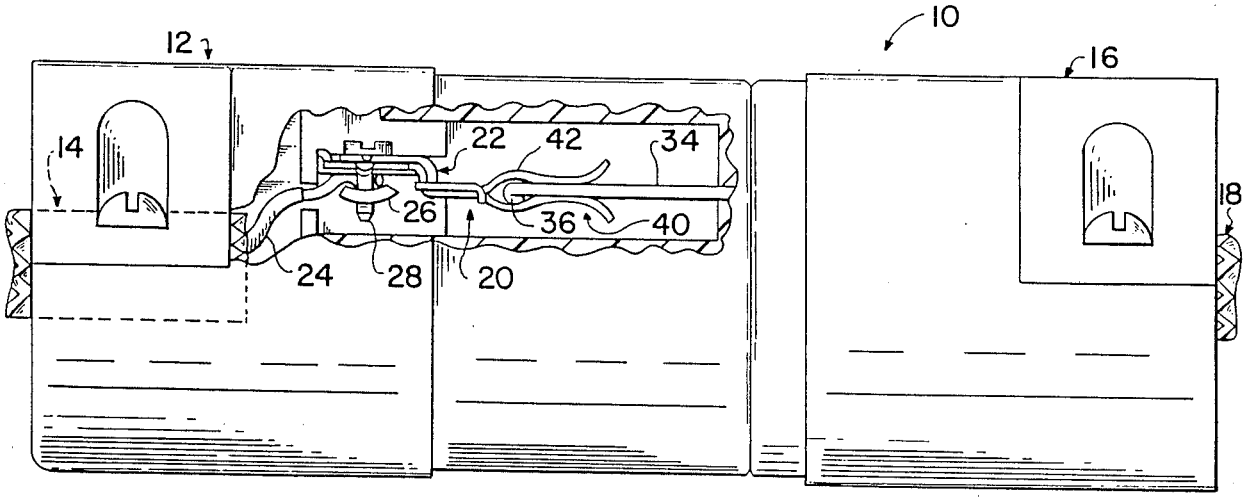
FIG. 1 is a side elevational view of an electrical connector assembly with a portion of the housing broken away to show a female contact clip engaging a male contact element in accordance with a first embodiment of the present invention.
Figure 2:
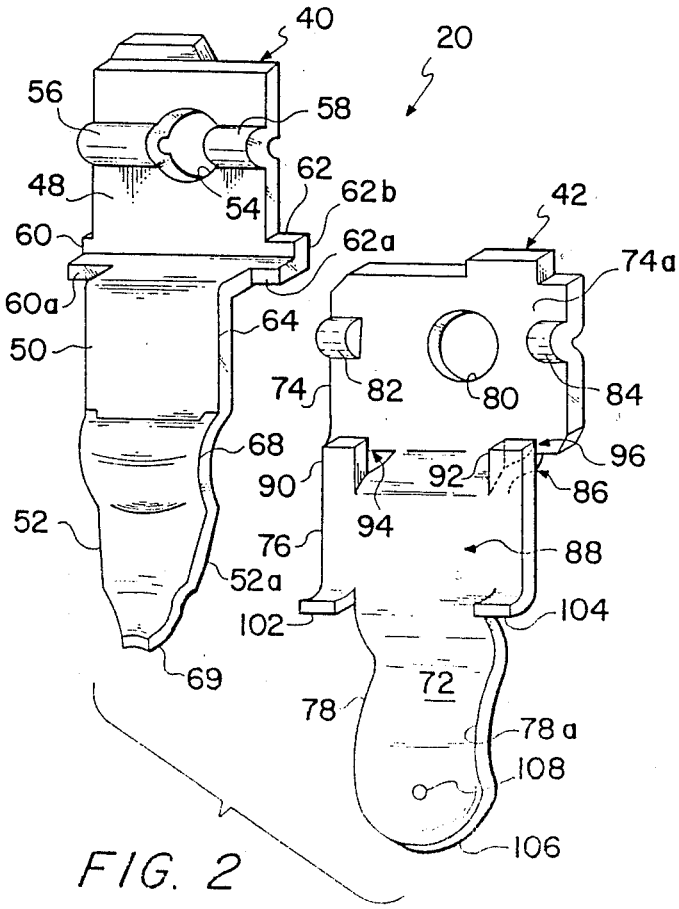
FIG. 2 is an enlarged, exploded perspective view, showing the preferred, first embodiment of an inside contact member and an outside contact member in accordance with the present invention.

Referring initially to FIG. 1, an electrical connector assembly 10 in accordance with the present invention includes a female receptacle housing 12 having an electrical cable 14 coupled thereto and a male plug housing 16 having an electrical cable 18 coupled thereto. Female receptacle housing 12 and male plug housing 16 are preferably molded from a plastic material and are well known in the art (see, e.g., U.S. Pat. No. 3,605,059 to Lipinski), and thus, are not illustrated or described in detail herein.

Female receptacle housing 12 supports three contact clips 20 (only one shown), each angularly spaced approximately 120° apart. Each contact clip 20 is positioned and retained in a recess 22 formed in female receptacle housing 12. A wire 24 from cable 14 is electrically coupled to contact clip 20 by a wire clamp 26 having threaded hole threadably receiving a terminal screw 28.

Male plug housing 16 supports three male contact elements or blades 34 (only one shown) for electrically engaging contact clips 20, as seen in FIG. 1. The ground male contact element 34 may have a key portion 36 for proper alignment and for twist locking as disclosed in U.S. Pat. No. 3,605,059 to Lipinski.

Referring now to FIGS. 2–9, the preferred embodiment of contact clip 20 is shown. Contact clip 20 includes an inside or first contact member 40 and an outside or second contact member 42. The inside and outside contact members 40 and 42 are both made of a resilient metallic material, such as Olin Brass Alloy #688—¼ hard having a Rockwell hardness ranging from about B86 to about B95. Inside and outside contact members 40 and 42 are each preferably formed by stamping a metallic blank having a thickness of about 0.04 inches to form a unitary contact member. Inside and outside contact members 40 and 42 are interlocked between their longitudinal ends.

Inside contact member 40, as particularly seen in FIGS. 4–7, includes an outer surface 44, an inner surface 46, a terminal portion 48, an intermediate portion 50 and a resilient contact portion 52.

Terminal portion 48 is generally rectangular in shape having a terminal hole 54 with a 0.174 inch diameter extending therethrough, and having a pair of stamped protrusions 56 and 58 extending outwardly from outer surface 44 of terminal portion 48. Protrusions 56 and 58 have a traversely extending convex, semi-cylindrical outer surface formed on outer surface 44 of terminal portion 48 for engaging and crimping wire 24 as seen in FIG. 1.

Intermediate portion 50 of inside contact member 40 includes a pair of tangs 60 and 62 extending laterally from contact member 40, each having a generally L-shaped cross section. Tangs 60 and 62 have outwardly facing, substantially coplanar surfaces 60*a* and 62*a*, and inwardly facing, substantially coplanar surfaces 60*b* and 62*b*, respectively. Surfaces 60*a* and 62*a* are substantially parallel to surfaces 60*b* and 62*b*. Intermediate portion 50 also includes a central section 64 extending from tangs 60 and 62 in a direction generally parallel to and away from terminal portion 48. Central section 64 has a generally planar transverse cross section.

Figure 5:
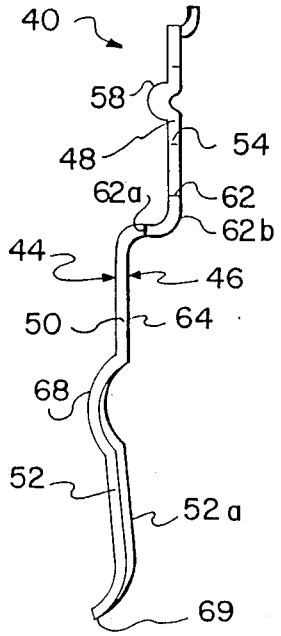
FIG. 5 is a side elevational view of the inside contact member of FIG. 4.
Figure 6:
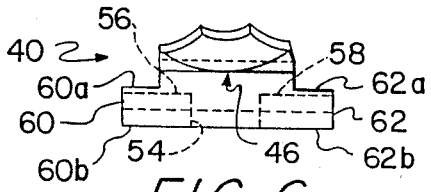
FIG. 6 is a bottom plan view of the inside contact member of FIG. 4.
Figure 7:
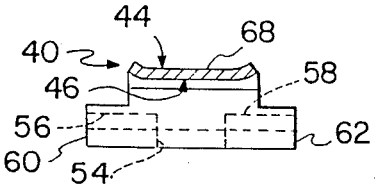
FIG. 7 is a bottom view in section of the inside contact member taken along line 7—7 of FIG. 4.

Contact portion 52 has a generally curved transverse cross section with its inner surface 46 being transversely convex, as particularly seen in FIGS. 6 and 7. Contact portion 52 has a formed section 68 for receiving key member 36 of male contact element 34 as seen in FIG. 1. Formed section 68 is curved to form a convex, partially cylindrical outer surface and a concave inner surface as seen in FIG. 5, extending transversely of the contact member's longitudinal axis. Free end 69 of contact portion 52 is flared towards outer surface 44 to serve as a ramp for guiding male contact element 34 as seen in FIG. 1.

Figure 8:
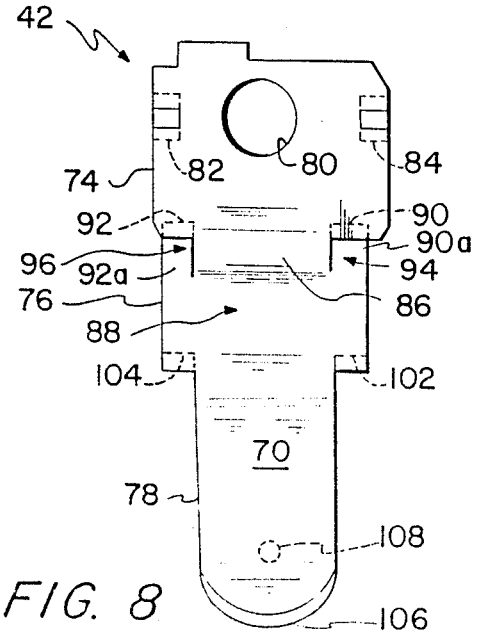
FIG. 8 is front elevational view of the outside contact member of FIG. 2.
Figure 9:
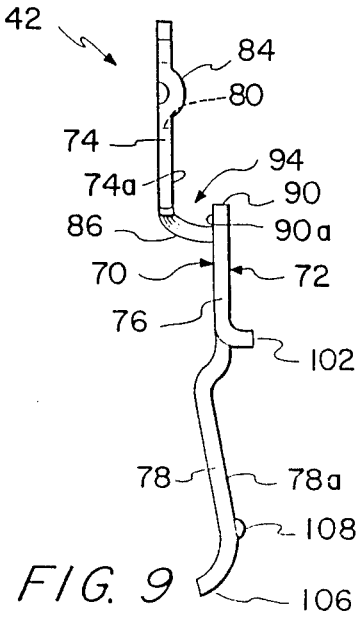
FIG. 9 is a side elevational view of the outside contact member of FIG. 8.

Outside contact member 42, as particularly seen in FIGS. 8 and 9, includes an outer surface 70, an inner surface 72, a terminal portion 74, an intermediate portion 76, and a resilient contact portion 78.

Terminal portion 74 is generally rectangular in shape having a terminal hole 80 with a 0.174 inch diameter extending therethrough and having a pair of stamped protrusions 82 and 84 extending outwardly from inner surface 72 and spaced transversely apart. Protrusions 82 and 84 straddle inside contact member 40 for preventing relative rotational movement between contact members 40 and 42 as particular seen in FIG. 3. Protrusions 82 and 84 have transversely extending convex outer surfaces which frictionally engage recess 22 in housing 12 as seen in FIG. 1.

Intermediate portion 76 of outside contact member 42 includes a spacing section 86 extending generally perpendicularly from terminal portion 74, a planar central section 88 extending from spacing section 86 in a plane generally parallel to and spaced from terminal portion 74. Central section 88 includes a pair of coupling flanges 90 and 92 extending toward and parallel to terminal portion 74. A pair of lugs or flanges 102 and 104 extend generally perpendicular to inner surface 72 of central section 88 remote from terminal portion 74. The lugs 102 and 104 lie adjacent the sides of first central section 64 limiting relative rotation of contact members 40 and 42. A pair of slots 94 and 96 are formed between coupling flanges 90 and 92 and terminal portion 74 for receiving tangs 60 and 62 of inside contact 40.

Contact portion 78 is generally S-shaped with its free end 106 flared towards outer surface 70 to serve as a ramp for guiding male contact element 34 as seen in FIG. 1. Contact portion 78 also includes a semi-spherical protrusion 108 extending from inner surface 72 for contacting male contact element 34.

Figure 3:
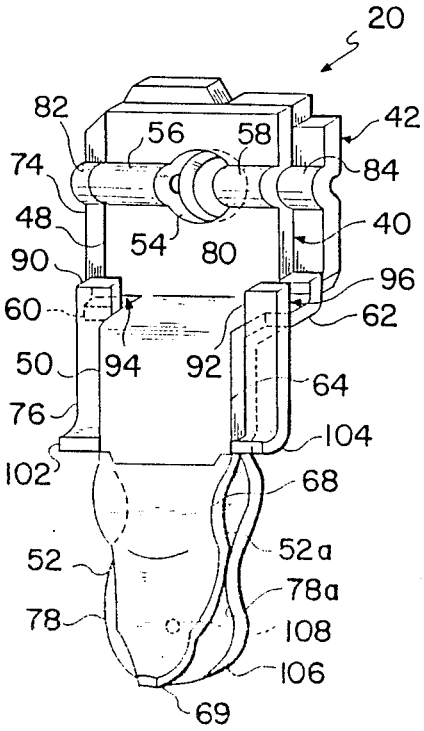
FIG. 3 is an enlarged, perspective view of the contact members of FIG. 2 in an assemblied position.
Figure 3A:
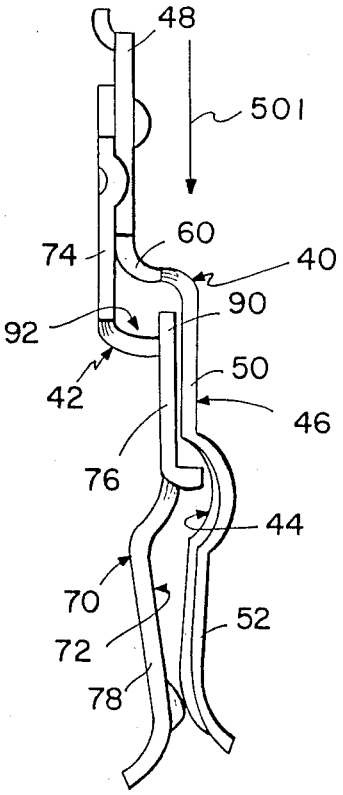
FIG. 3A is a side elevational view of the contact members of FIG. 2 as the contact members are being assembled.
Figure 3B:
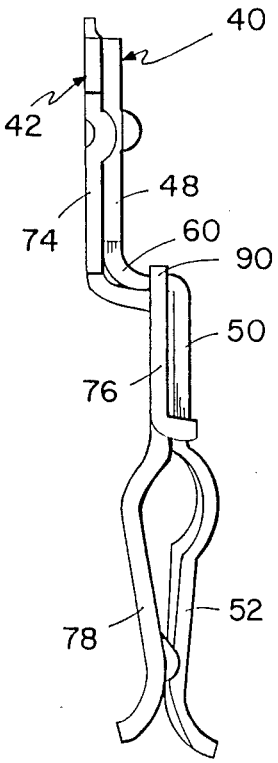
FIG. 3B is a side elevational view of the contact members of FIG. 3A in a fully assembled position.
Figure 4:
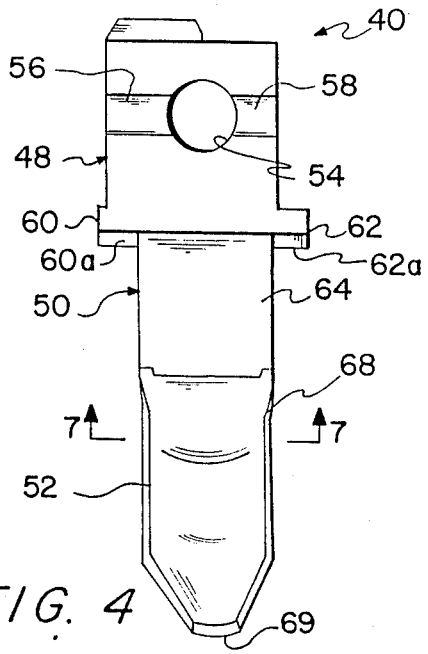
FIG. 4 is a front elevational view of the inside contact member of FIG. 2.

Contact members 40 and 42 are interlocked by tangs 60 and 62 and flanges 90 and 92. In particular, tangs 60 and 62 are slid vertically in the direction of arrow 501 into slots 94 and 96 as illustrated in FIG. 3A until tangs 60 and 62 are positioned and retained between outer surfaces **90*a* and 92*a* of coupling flanges 90 and 92, and inner surface 74*a* of terminal portion 74 as illustrated in FIG. 3B. The perpendicular distance (typically between about 0.085 and 0.090 inch) between outwardly facing surfaces 60*a* and 62*a* and inwardly facing surfaces 60*b* and 62*b* is at least slightly smaller than the perpendicular distance (typically about 0.091 inch) across slots 94 and 96, i.e., between surfaces 90*a* and 92*a* of coupling flanges 90 and 92 and inner surface 74*a* of terminal portion 74. Thus, when tangs 60 and 62 are slid into slots 94 and 96, surfaces 60*a*, 60*b*, 62*a* and 62*b* of contact member 40 will be received between surfaces 90*a*, 92*a* and 74*a* of contact member 42** with a clearance fit. However, the tangs can also be retained by an interference fit in the slots.

When tangs 60 and 62 are slid into slots 94 and 96, contact portions 52 and 78 will be located opposite each other. The preformed shape or configuration of the contact portions cause the contact portions to engage and press against each other and to bend about an axis transverse to the longitudinal axes of the contact members when the contact members are interlocked by tangs 60 and 62 and flanges 90 and 92. Additionally, the terminal portions 48 and 74 are pressed against each other.

Thus, the connection of the contact members is solely the function of the configuration, shape or form of the contact members themselves. These configurations are measurable and easily maintained by the dies producing the contact members. The connections are not dependent upon secondary operations such as riveting or welding which cannot be easily controlled for reproducible results.

Figure 10:
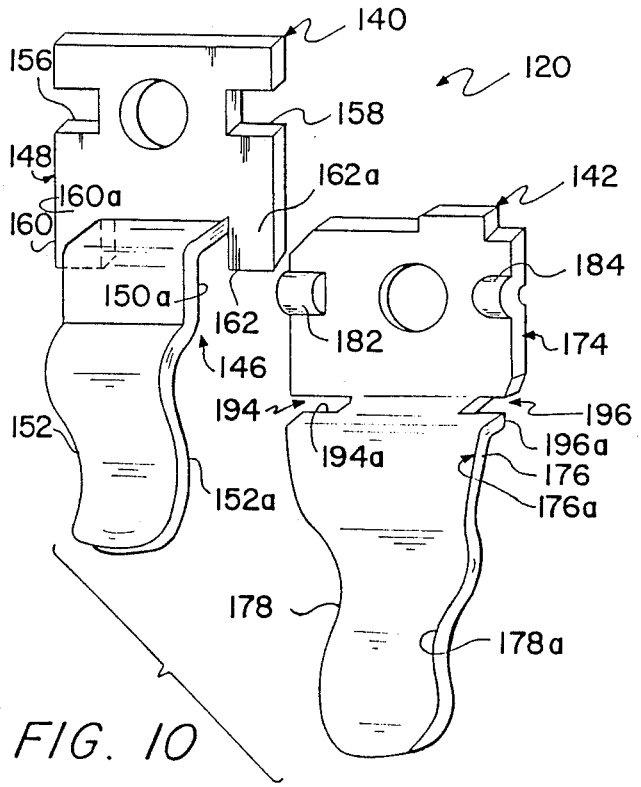
FIG. 10 is an exploded perspective view of a contact clip in accordance with a second embodiment of the present invention.

Referring now to the second embodiment of the present invention, as seen in FIG. 10, contact clip 120 includes an inside contact member 140 and an outside contact member 142 which are substantially identical to contact members 40 and 42 of contact clip 20, except for changes in the shape of the clip contact portions (i.e., a straight blade contact portion) and of the coupling members for interlocking the contact members 140 and 142 together. Contact portions 152 and 178 can be made similar to contact portions 52 and 78 shown in the first embodiment.

In the second embodiment, the coupling members for interlocking contact members 140 and 142 together include a pair of tangs 160 and 162 extending downwardly from terminal portion 148 of inside contact member 140, and a pair of slots 194 and 196 formed in intermediate portion 176 of outside contact clip 142. Tangs 160 and 162 are received with a clearance fit in slots 194 and 196. An interference fit could also be used. Central section inner surface **150*a* of member 140 is positioned adjacent central section inner surface 176*a* of member 142. Inwardly facing coplanar surfaces 160*a* and 162*a* on tangs 160 and 162 of member 140 engage outwardly facing coplanar surfaces 194*a* and 196*a* in slots 194 and 196 of member 142**.

When tangs 160 and 162 are slid into slots 194 and 196, contact portions 152 and 178 will be located opposite each other. The preformed shape or configuration of the contact portions cause the contact portions to engage and press against each other and to bend about an axis transverse to the longitudinal axes of the contact members when the contact members are interlocked by tangs 160 and 162 and flanges 190 and 192. Additionally, the terminal portions 148 and 174 are pressed against each other.

Rotational movement between contact members 140 and 142 is prevented. Protrusions 182 and 184 of outside contact member 142 are received in cutouts 156 and 158 of inside contact member 140 to prevent relative rotation.

Figure 11:
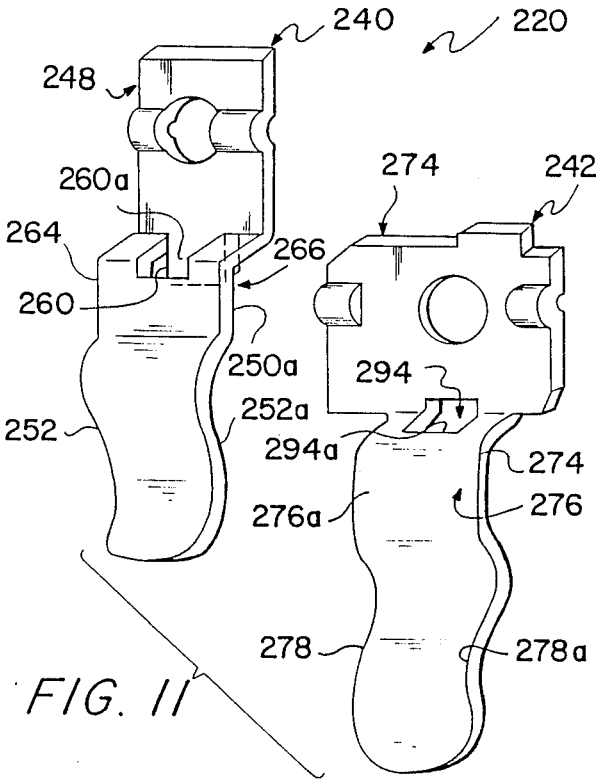
FIG. 11 is an exploded perspective view of a contact clip in accordance with a third embodiment of the present invention.

A third embodiment of the present invention is illustrated in FIG. 11. Contact clip 220 includes an inside contact member 240 and an outside contact member 242 which are substantially identical to contact members 40 and 42, except for changes in the shape of the clip contact portions (i.e., a straight blade contact portion) and the coupling members for interlocking contact members 240 and 242.

In the third embodiment, the coupling members of contact clip 220 include a downwardly extending tang 260 forming a space 266 between tang 260 and outer surface **250*a* of inside contact member 240, and a slot 294 formed in intermediate portion 274 of outside contact member 242 for receiving tang 260. Tang 260 is received in slot 294 with a clearance fit so that central section outer surface 250*a* of member 240 is adjacent central section inner surface 276*a* of member 240. An interference fit could also be used. Inwardly facing surface 260*a* on tang 260 of member 240 engages slot outwardly facing surface 294*a* of member 242**.

When tang 260 is slid into slot 294, contact portions 252 and 278 will be located opposite each other. The preformed shape or configuration of the contact portions cause the contact portions to engage and press against each other and to bend about an axis transverse to the longitudinal axes of the contact members when the contact members are interlocked by tang 260 and slot 294. Additionally, the terminal portions 248 and 274 are pressed against each other.

Figure 12:
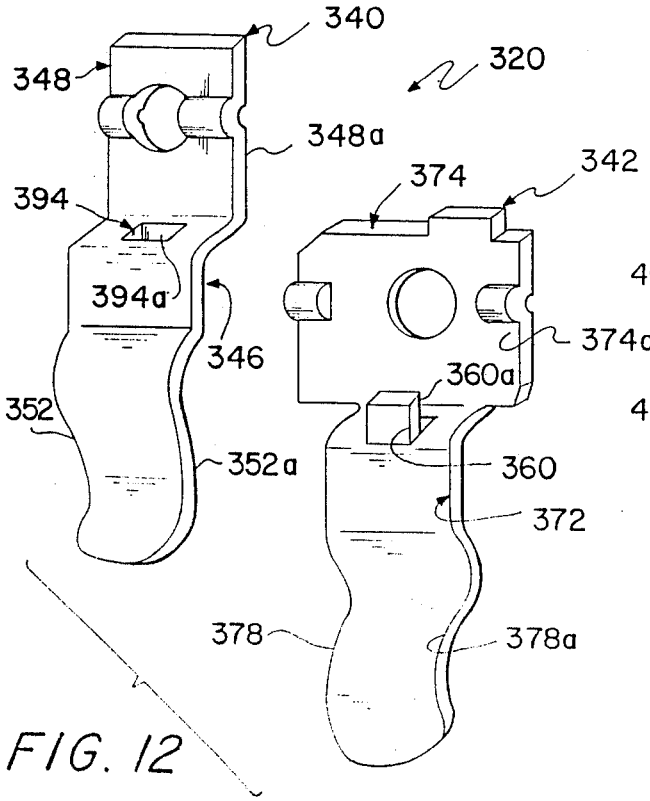
FIG. 12 is an exploded perspective view of a contact clip in accordance with a fourth embodiment of the present invention.

The fourth embodiment of the present invention is shown in FIG. 12. Contact clip 320 includes an inside contact member 340 and an outside contact member 342 which are substantially identical to contact members 40 and 42 except for changes in the shape of the clip contact portions (i.e., a straight blade contact portion) and the coupling members for interconnecting contact members 340 and 342 together.

In the fourth embodiment, the coupling members of contact clip 320 include an upwardly extending tang 360 on outside contact member 342 and a slot 394 formed in inside contact member 340. Contact members 340 and 342 are interlocked by tang 360 being received in slot 394 with a clearance fit. An interference fit could also be used. Outwardly facing surface 360*a* on tang 360 of member 340 engages inwardly facing surface 394*a* in slot 394 of member 340.

When tang 360 is slid into slot 394, contact portions 352 and 378 will be located opposite each other. The preformed shape or configuration of the contact portions cause the contact portions to engage and press against each other and to bend about an axis transverse to the longitudinal axes of the contact members when the contact members are interlocked by tang 360 and slot 394. Additionally, terminal portion outer surface 348*a* of member 340 frictionally engages or is pressed against terminal portion inner surface 374*a* of member 342.

Figure 13:
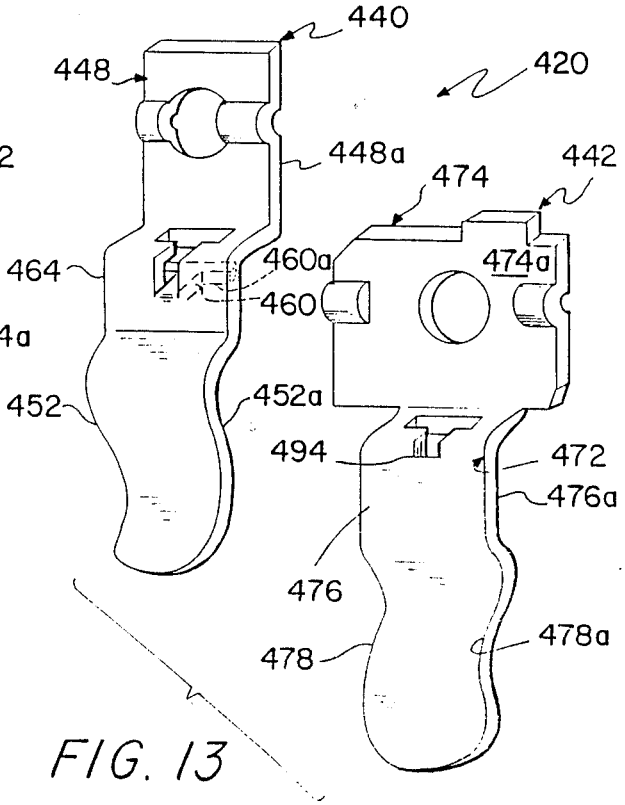
FIG. 13 is an exploded perspective view of a contact clip in accordance with a fifth embodiment of the present invention.

The fifth embodiment of the present invention is illustrated in FIG. 13. Contact clip 420 includes an inside contact member 440 and an outside contact member 442 which are substantially identical to contact members 40 and 42 of coupling clip 20 except for changes in the shape of the clip contact portions (i.e., a straight blade contact portion) and the coupling members for interconnecting them together.

In the fifth embodiment, the coupling member of contact clip 420 includes a T-shaped tang 460 extending perpendicularly to central section 464 of inside contact member 440 and a T-shaped slot 494 in central section 476 of outside contact member 442.

Contact members 440 and 442 are interlocked by tang 460 and slot 494. In particular, tang 460 is received in slot 494 with a clearance fit. An interference fit could also be used. Inwardly facing surface 460*a* on tang 460 of member 440 engages central section outwardly facing surface 476*a* of member 442.

When tang 460 is slid into slot 494, contact portions 452 and 478 will be located opposite each other. The preformed shape or configuration of the contact portions cause the contact portions to engage and press against each other and to bend about an axis transverse to the longitudinal axes of the contact members when the contact members are interlocked by tang 460 and slot 494. Additionally, terminal portion outer surface 448*a* of member 440 frictionally engages or is pressed against terminal portion inner surface 474*a* of member 442.

In each of the embodiments disclosed, the coupling members (i.e., tang(s) and slot(s) of the contact members) are located between the terminal portions and the contact portions. The contact members are interlocked so that upon insertion of a mating contact element between the contact portions, the coupling members act as a fulcrum to force the terminal portions together as the contact portions are separated. Movement of the mating contact elements during use creates a more intimate contact of the contact members at the fulcrum and terminal portion. Accordingly, firm electrical contact is always maintained between the contact members. Since each contact member extends the full length of the contact clip, the contact members form two parallel conducting paths between the mating contact element and the wire, providing cooler operation.

When assembling the contact clips in a wiring device, such as female receptacle housing 12 shown in FIG. 1, the inside and outside contact members are first coupled together by sliding the contact members longitudinally relative to one another. In this manner, the tang or tangs of one contact member engages the slot or slots in the other contact member as discussed above. After the inside and outside contact members are connected, terminal screw 28 is inserted into the terminal holes of the inside and outside contact members and is threadably engaged with wire clamp 26. The screw squeezes the terminal portions of the two contact members together, and prevents uncoupling of the contact members during manufacture. The terminal portion of the outside contact member is then inserted into recess 22 of female receptacle housing 12 with wire clamp 26 positioned directly adjacent the inside contact member. The wire 24 can then be inserted between the inside contact member and wire clamp 26 and is electrically secured to the contact clip by tightening terminal screw 28.

While several embodiments have been shown to illustrate the invention, it will be understood by those skilled in the art that various changes and modifications can be made therein without departing from the scope of the invention as defined in the appended claims.

What is claimed is:

1. An electrical contact clip for a wiring device, comprising:

a first contact member having a first terminal portion adapted to be electrically coupled to wiring, a resilient first contact portion for electrically engaging a mating contact element, and a first intermediate portion extending between said first terminal portion and said first contact portion;

a second contact member having a second terminal portion adapted to be electrically coupled to wiring, a resilient second contact portion for electrically engaging a mating contact element with said first contact portion, and a second intermediate portion extending between said second terminal portion and said second contact portion; and first and second interlocking means, on said first and second contact members, respectively, for connecting said first and second contact members together adjacent said intermediate portions such that said contact portions engage and press against each other and are bent about an axis transverse to longitudinal axes of said contact members.

2. An electrical contact clip according to claim 1, wherein lug means is coupled to at least one of said first and second contact members for preventing relative rotation of said first and second contact members.

3. An electrical contact clip according to claim 2, wherein said lug means comprises a pair of flanges extending from said second intermediate portion to engage said first intermediate portion.

4. An electrical contact clip according to claim 2, wherein said lug means comprises a pair of protrusions extending from said second terminal portion to engage said first terminal portion.

5. An electrical contact clip according to claim 1, wherein said first interlocking means comprises a pair of unitary tangs extending from said first contact member; and said second interlocking means comprises a pair of unitary coupling flanges extending from said second intermediate portion, said tangs being received between said coupling flanges and said second terminal portion such that said tangs are retained therebetween.

6. An electrical contact clip according to claim 5, wherein said tangs have generally L-shaped cross sections and extend laterally from said first contact member.

7. An electrical contact clip according to claim 1, wherein said first interlocking means comprises at least one unitary tang extending from said first contact member; and said second interlocking means comprises at least one unitary slot formed in said second intermediate portion for receiving said tang therein such that said first and second contact members are retained together.

8. An electrical contact clip according to claim 7, wherein said first interlocking means comprises a pair of tangs; and said second interlocking means comprises a pair of slots for receiving said tangs.

9. An electrical contact clip according to claim 7, wherein said tang is generally T-shaped and said slot is generally T-shaped.

10. An electrical contact clip according to claim 1, wherein said first and second contact members are each formed of an unitary sheet of metal.

11. An electrical contact clip according to claim 1, wherein said contact members have substantially equal lengths and extend along the full length of each other.

12. An electrical contact clip for use in a wiring device, comprising:

a first contact member formed of a single continuous sheet of metal, and first contact member including a first terminal portion adapted to be electrically coupled to wiring, a resilient first contact portion for electrically engaging a mating contact element, and a first intermediate portion extending between said first terminal portion and said first contact portion, said first intermediate portion having a pair of tangs extending laterally therefrom; and a second contact member formed of a single continuous sheet of metal, said second contact member including a second terminal portion adapted to be electrically coupled to wiring, said second terminal portion having an inner surface, a resilient second contact portion for electrically engaging a mating contact element, and a second intermediate portion extending between said second terminal portion and said second contact portion, said second intermediate portion having a pair of coupling flanges extending substantially parallel to said second terminal portion, each of said coupling flanges having a surface facing and spaced from said inner surface of said second terminal portion;

whereby said tangs are received between said coupling flanges and said inner surface of said second terminal portion such that said tangs are retained between said coupling flanges and said inner surface of said second terminal portion interlocking said first and second contact members together such that said contact portions engage and press against each other and are bent about an axis transverse to longitudinal axes of said contact members.

13. An electrical contact clip according to claim 12, wherein lug means is coupled to at least one of said first and second contact members for preventing relative rotation of said first and second contact members.

14. An electrical contact clip according to claim 13, wherein said lug means comprises a pair of flanges extending from said second intermediate member to engage said first intermediate portion.

15. An electrical contact clip according to claim 13, wherein said lug means comprises a pair of protrusions extending from said second terminal portion to engage said first terminal portion.

16. An electrical contact clip according to claim 13, wherein said tangs have generally L-shaped cross sections and extend laterally from said first contact member.

* * * * *